US008529274B2

(12) United States Patent
Li et al.

(10) Patent No.: US 8,529,274 B2
(45) Date of Patent: Sep. 10, 2013

(54) ELECTRICAL COUPLER

(75) Inventors: Ming Li, Shenzhen (CN); Bo Peng, Shenzhen (CN); Wen-Hsing Lin, New Taipei (TW); Kun-Chih Hsieh, New Taipei (TW)

(73) Assignees: Hong Fu Jin Precision Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 138 days.

(21) Appl. No.: 13/313,021

(22) Filed: Dec. 7, 2011

(65) Prior Publication Data

US 2012/0184114 A1 Jul. 19, 2012

(51) Int. Cl.
*H01R 11/30* (2006.01)

(52) U.S. Cl.
USPC ..... 439/38

(58) Field of Classification Search
USPC ..... 439/38, 39–40, 305, 620.21, 620.03, 439/680, 217–218
See application file for complete search history.

(56) References Cited

U.S. PATENT DOCUMENTS

| | | | | |
|---|---|---|---|---|
| 7,645,143 | B2 * | 1/2010 | Rohrbach et al. | 439/39 |
| 7,658,613 | B1 * | 2/2010 | Griffin et al. | 439/39 |
| 8,167,625 | B2 * | 5/2012 | Shedletsky | 439/55 |
| 2001/0031565 | A1 * | 10/2001 | Sakiyama | 439/38 |

* cited by examiner

*Primary Examiner* — Jean F Duverne
(74) *Attorney, Agent, or Firm* — Altis Law Group, Inc.

(57) ABSTRACT

A male connector is capable of magnetically attracting a female connector. The female connector includes a first end surface and a second end surface. The male connector includes a first telescoping pin and a second telescoping pin. The first telescoping pin and the second telescoping pin are capable of contacting the first end surface and the second end surface, to make an electrical connection between the male connector and the female connector.

10 Claims, 4 Drawing Sheets

ELECTRICAL COUPLER

BACKGROUND

1. Technical Field

The present disclosure relates to electrical couplers and, particularly, to a male connector and a female connector that are magnetically connected together.

2. Description of Related Arts

Although electrical connectors connected together by magnetic force are known in the art, there is room for improvement.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
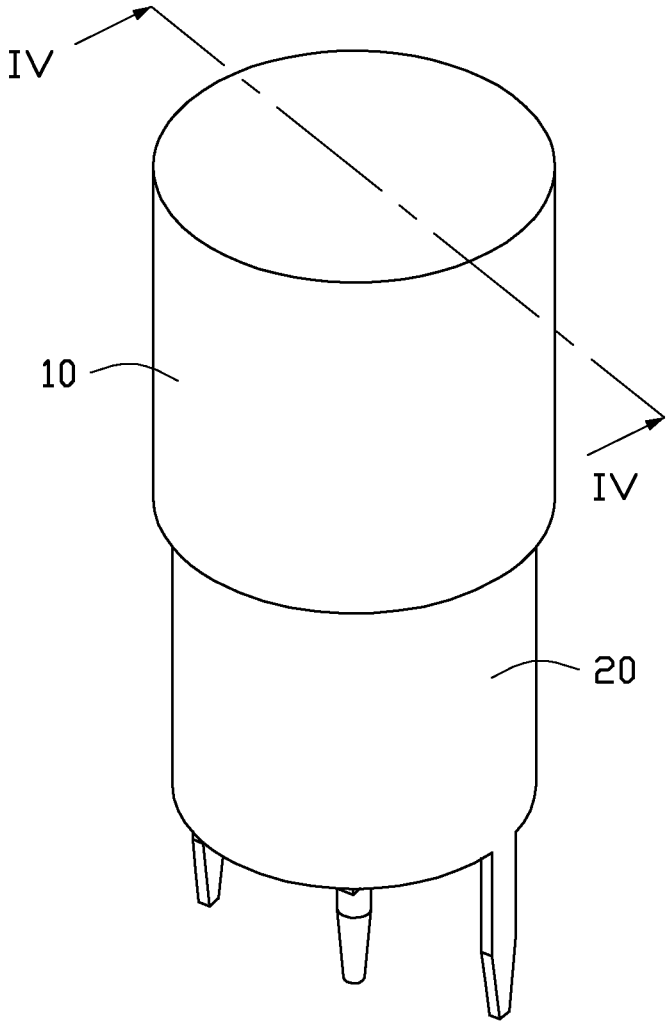
FIG. 1 is an isometric view of a plug coupled to a receptacle according to an embodiment.
Figure 2:
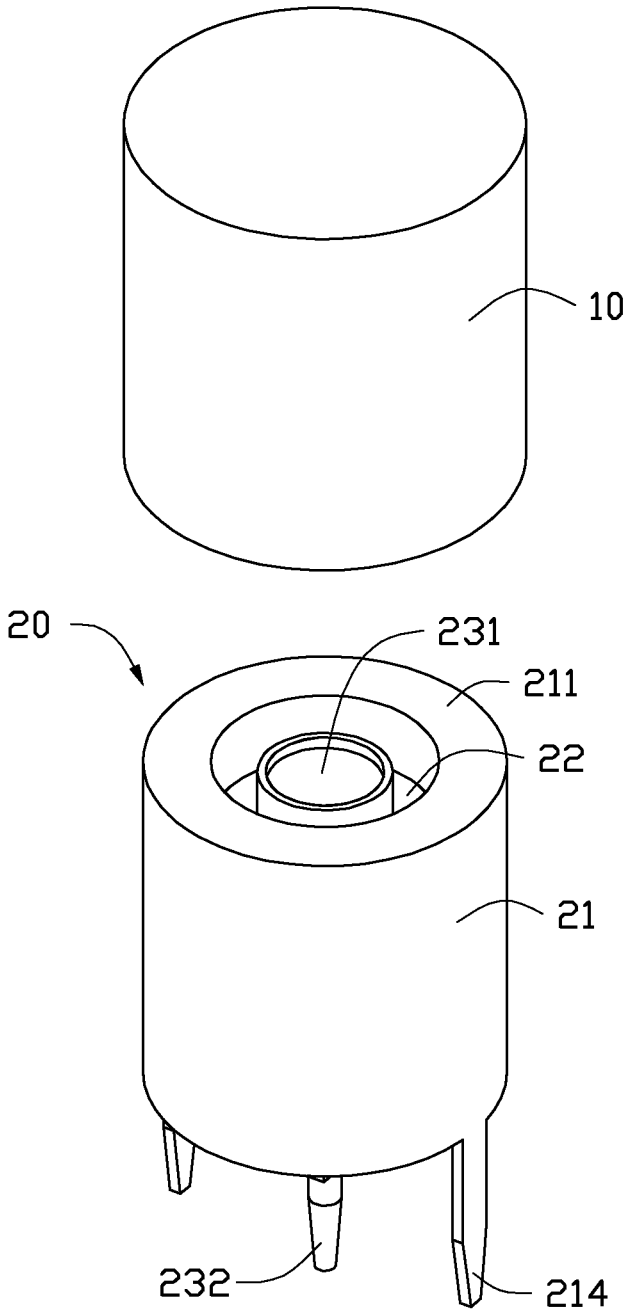
FIG. 2 is an isometric, exploded view of the plug and the receptacle of FIG. 1.

Referring to FIGS. 1 and 2, a male connector/plug 10 and a female connector/receptacle 20 are coupled together. The plug 10 and the receptacle 20 are direct current (DC) connectors that are respectively fixed to a charger (not shown) and in a housing of an electronic device (not shown). An electronic connection can be made between the electronic device and a power source via the charger.

Figure 3:
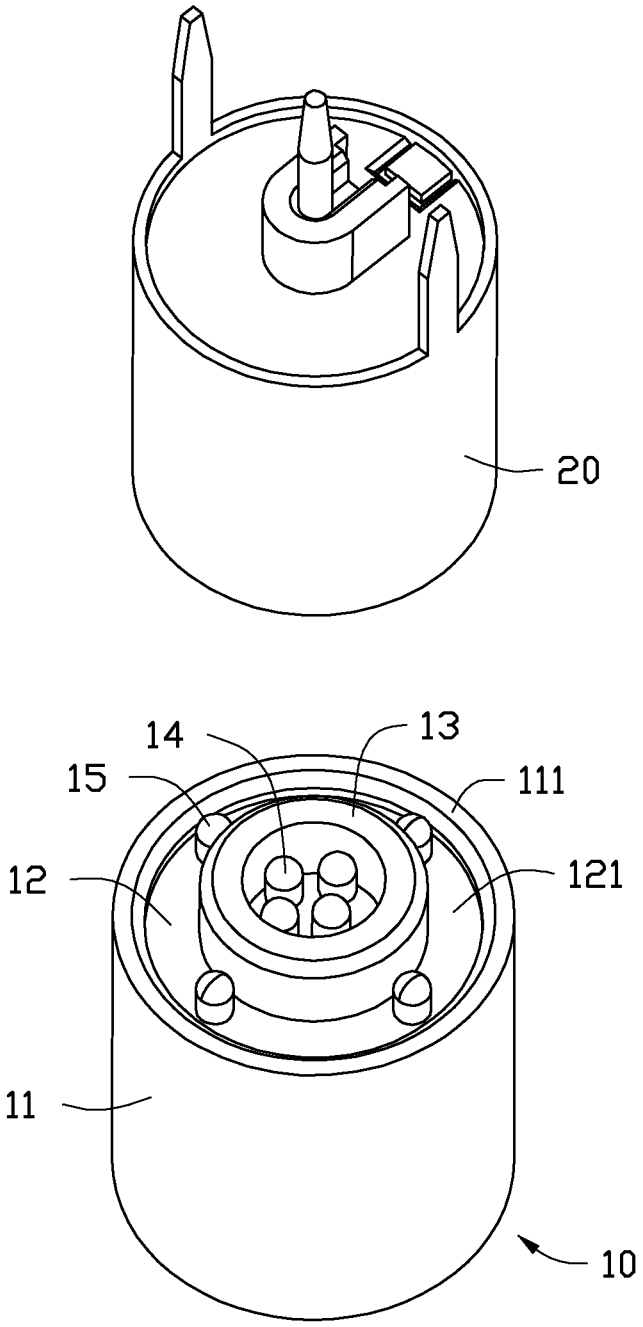
FIG. 3 is similar to FIG. 2, but viewed from another viewpoint.

Referring to FIG. 3, the plug 10 is cylindrical and includes a hollow metal housing 11, and an insulating retainer 12 retained within the housing 11. One end 121 of the retainer 12 is dented inward at one end 111 of the housing 11. A barrel 13 made of magnetic material protrudes from the end 121. In the embodiment, the barrel 13 and the housing 11 are both cylindrical.

A number of first terminals 14 and a number of second terminals 15 protrude from the end 121 of the retainer 12. The terminals 14 are received in the barrel 13, while the terminals 15 are arranged outside the barrel 13. The terminals 14 and 15 are telescoping terminals. In the embodiment, each of the terminals 14 and 15 is connected to an elastic member 16, such as a coil spring. The terminals 14 and 15 can be urged into the retainer 12 and can rebound under force of the elastic member 16. The elastic members 16 are respectively connected to a number of wires of the charger.

Figure 4:
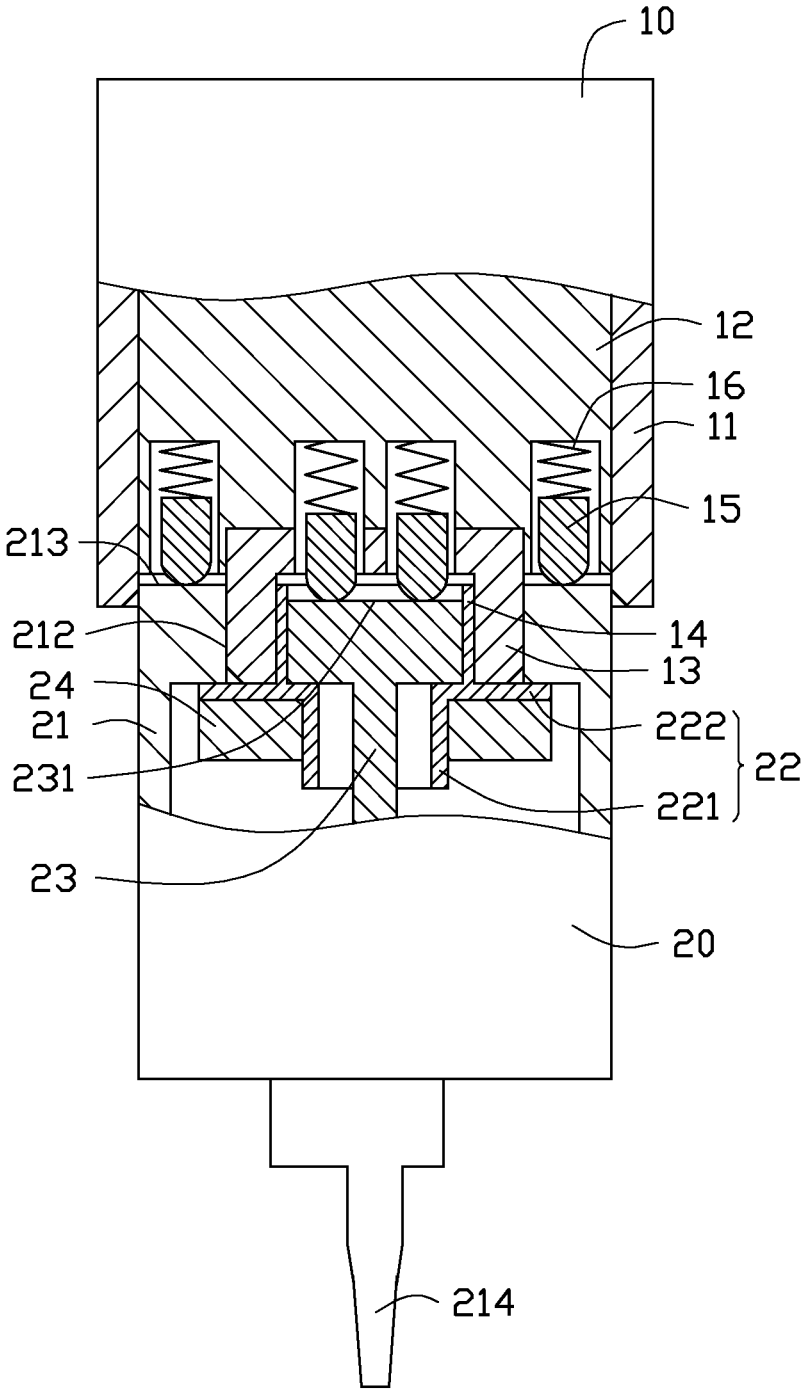
FIG. 4 is a cross-sectional view of the plug and the receptacle, taken along the line IV-IV of FIG. 1.

Referring to FIGS. 2 and 4, the receptacle 20 includes a hollow metal housing 21, an insulating barrel 22, a metal post 23, and a magnetic member 24. The housing 21 includes an end wall 211 at an end thereof, and defines a through opening 212 in the wall 211. The outer surface of the wall 211 defines a second end surface 213. In the embodiment, the end surface 213 is an annular surface. The barrel 22 includes a barrel body 221 and a flange 222 extending from the lateral surface of the barrel body 221. The housing 21 further includes a number of pins 214 that connect with a circuit board of the electronic device.

The flange 222 abuts against an inner surface of the wall 211 of the housing 21. A portion of the housing 211 at one side of the flange 222 is received in the through opening 212 of the housing 21. The metal post 23 is retained within the barrel 22 and includes an end that defines a first end surface 231. An opposite end 232 of the metal post 23 is electrically connected to the circuit board of the electronic device. The magnetic member 24 is a ring and is sleeved on the barrel 22. The magnetic member 24 is a magnet that abuts against the flange 222.

Referring to FIG. 4, when the plug 10 is inserted into the receptacle 20, the barrel 13 of the plug 10 is received in the through hole opening 212 of the receptacle 20 and sleeves on the barrel body 221 of the receptacle 20. The first terminals 14 of the plug 10 contact the first end surface 231 of the metal post 23, and are urged to retract into the retainer 12. The end wall 211 of the housing 21 is received between the housing 11 and the barrel 13. The second end surface 213 of the wall 211 abuts against the second terminals 15. The second terminals 15 are urged into the retainer 12.

Because the magnet 24 of the receptacle 20 attracts the barrel 13 of the plug 10, the terminals 14 and 15 can stay in tight contact with the first end surface 231 and the second end surface 213.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A male connector capable of magnetically connecting with a coupling female connector, the female connector comprising a first end surface and a second end surface, the male connector comprising:

a first telescoping pin;

a second telescoping pin, wherein the first telescoping pin and the second telescoping pin are capable of contacting the first end surface and the second end surface, to make an electrical connection between the male connector and the female connector; and a hollow metal housing comprising an electrically insulating retainer fixed within the housing, wherein a barrel protrudes from an end of the retainer, the first telescoping pin protrudes from the end of the retainer and is arranged within the barrel, the second telescoping pin protrudes from the end of the retainer and is arranged between a side wall of the metal housing and the barrel.

2. The male connector according to claim 1, wherein each of the first telescoping pin and the second telescoping pin is connected with an elastic member, each of the elastic members is to provide a rebounding force to the first telescoping pin and the second telescoping pin.

3. The male connector according to claim 1, wherein the elastic members are coil springs.

4. The male connector according to claim 1, wherein the second end surface is an annular surface.

5. A female connector capable of magnetically connecting with a coupling male connector, the male connector comprising a first telescoping pin and a second telescoping pin, the female connector comprising:

a first end surface; and a second end surface, wherein the first end surface and the second end surface are capable of contacting the first telescoping pin and the second telescoping pin, to make an electrical connection between the male connector and the female connector;

a metal housing comprising an end wall at one end and defining a through opening, wherein an outer surface of the end wall defines the second end surface;

an insulating barrel comprising a flange extending radially from a lateral surface thereof and abutting against an inner surface of the end protruding wall, wherein a portion of the barrel at one side of the flange is received in the through opening;

a metal post retained within the barrel and comprise an end defining the first end surface; and a magnetic member sleeved on the barrel at opposite side of the flange.

6. The female connector according to claim 5, wherein the magnetic member is a magnet.

7. An electrical coupler comprising:

a male connector comprising:

a first telescoping pin;

a second telescoping pin; and a hollow metal housing comprising an electrically insulating retainer fixed within the housing, wherein a barrel protrudes from an end of the retainer, the first telescoping pin protrudes from the end of the retainer and is arranged within the barrel, the second telescoping pin protrudes from the end of the retainer and is arranged between a side wall of the metal housing and the barrel; and a female connector comprising:

a first end surface; and a second end surface, wherein the first end surface and the second end surface are capable of contacting the first telescoping pin and the second telescoping pin, to make an electrical connection between the male connector and the female connector;

a metal housing comprising an end wall at one end and defining a through opening, wherein an outer surface of the end wall defines the second end surface;

an insulating barrel comprising a flange extending radially from a lateral surface thereof and abutting against an inner surface of the end wall, wherein a portion of the barrel at one side of the flange is received in the through opening;

a metal post retained within the barrel and comprise an end defining the first end surface; and a magnetic member sleeved on the barrel at opposite side of the flange.

8. The coupler according to claim 7, wherein each of the first telescoping pin and the second telescoping pin is connected with an elastic member, each of the elastic members is to provide a rebounding force to the first telescoping pin and the second telescoping pin.

9. The coupler according to claim 7, wherein the elastic members are coil springs.

10. The coupler according to claim 7, wherein magnetic member is a magnet.

* * * * *